US005169500A

United States Patent [19]

Mejdell

[11] Patent Number: 5,169,500

[45] Date of Patent: Dec. 8, 1992

[54] ADJUSTABLE ANGLE FOIL FOR PAPER MAKING MACHINE WITH RIGID FOIL BODY AND CAM ACTUATION MEANS

[75] Inventor: Daniel E. Mejdell, Portland, Oreg.

[73] Assignee: Wilbanks International, Hillsboro, Oreg.

[21] Appl. No.: 776,551

[22] Filed: Oct. 15, 1991

[51] Int. Cl.[5] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 3,017,930 | 1/1962 | Dunlap | 162/352 |
| 3,027,940 | 4/1962 | Dunlap | 162/352 |
| 3,140,225 | 7/1964 | Truxa | 162/352 |
| 3,201,308 | 8/1965 | Goddard et al. | 162/352 |
| 3,220,920 | 11/1965 | Truxa | 162/352 |
| 3,323,982 | 6/1967 | Hill | 162/374 |
| 3,520,775 | 7/1970 | Truxa | 162/374 |
| 3,535,201 | 10/1970 | Reynolds et al. | 162/352 |
| 3,576,716 | 4/1971 | Reynolds | 162/374 |
| 3,647,620 | 3/1972 | Truxa | 162/352 |
| 4,061,532 | 12/1977 | Biondetti | 162/352 |
| 4,162,937 | 7/1979 | Corbellini | 162/352 |
| 4,184,915 | 1/1980 | Metcalf | 162/352 |
| 4,334,958 | 6/1982 | Baluha et al. | 162/352 |
| 4,416,731 | 11/1983 | Pesonen et al. | 162/308 |
| 4,865,692 | 9/1989 | Kade et al. | 162/352 |
| 5,061,347 | 10/1991 | Bubik et al. | 162/352 |

*Primary Examiner*—W. Gary Jones
*Assistant Examiner*—Brenda Lamb
*Attorney, Agent, or Firm*—Klarquist, Sparkman, Campbell, Leigh & Whinston

[57] ABSTRACT

An adjustable angle foil apparatus for a paper making machine is described in which a rigid foil member is pivoted by a cam actuated adjustment mechanism to change the foil angle. The cam actuator includes at least a rear set of cam slots and cam follower pins connecting a foil support member to a foil mounting base member to pivot support member in response to longitudinal movement thereof for adjustment of the foil angle. A rigid foil body made of foil segments of ceramic or other hard, wear resistant material, are attached by tongue and groove connections and bonding adhesive to the foil support member. The cam actuated adjustment mechanism pivots such support member to adjust the foil angle without bending the foil. In one embodiment a front set of cam slots and cam follower pins is provided to maintain the height of the leading edge of the foil substantially constant at different foil angles. In a second embodiment the ends of the pins are connected to cam slide rods which extend across the pins and fit into the cam slots. In a third embodiment, the front set of cam slots and pins is replaced by a pivot rod attached to the front of the mounting base member about which the foil and foil support member pivot in response to the rear cam actuator adjustment of the foil angle.

20 Claims, 3 Drawing Sheets

7

ADJUSTABLE ANGLE FOIL FOR PAPER MAKING MACHINE WITH RIGID FOIL BODY AND CAM ACTUATION MEANS

BACKGROUND OF THE INVENTION

The present invention relates generally to dewatering elements for paper making machines and in particular to adjustable foil apparatus with a cam actuated adjustment means for adjusting the foil angle that a rigid foil body of ceramic or other hard wear resistant material makes with the conveyor belt carrying the paper stock over the foils in such paper making machine, without bending the foil body. The adjustable foil apparatus of the present invention is especially useful for paper making machines in which the foil angle is adjusted without removing the foil apparatus from the paper making machine and without stopping the conveyor belt of such paper making machines.

Previously it has been proposed in U.S. Pat. No. 3,027,940 of Dunlap, issued Apr. 3, 1962, to provide a foil apparatus for a paper making machine including a foil member having a bearing surface of plastic material mounted on a flexible metal sheet which can be adjusted by bending the foil. The angle of the foil is adjusted by bending the foil body in response to the amount of air pressure applied to the interior of two flexible hoses within the foil mount which cause the foil rear portion to move down against an adjustable stop. This has several disadvantages, including the fact that it is not suitable for use with rigid foil body members such as those made of ceramic or other hard wear resistant material, which are not flexible. Also, the adjusting mechanism is extremely complicated, requires uniform adjustment of stop screws, and is subject to failure if the inflatable hose is damaged or otherwise develops a leak.

Another type of flexible foil apparatus for paper making machines, whose angle is adjusted by bending the foil member is shown in U.S. Pat. No. 3,140,225 of Truxa, issued Jul. 7, 1964. This foil includes a plastic or other non-metallic cover member mounted on a spring steel support which is bent by the movement of pin projections with a sliding adjustment bar, which engage cam slots in the spring support mounting member. This has the disadvantage again that a long wearing foil having a rigid body member made of ceramic material cannot be employed, since such a rigid body is not flexible and cannot be bent to adjust the foil angle.

U.S. Pat. No. 3,201,308 of Goddard, et al., issued Aug. 17, 1965, and U.S. Pat. No. 3,220,920 of Truxa, issued Nov. 30, 1965, shows another type of drainage foil apparatus including a flexible foil member with a thin flexible neck portion which is adjusted by bending the foil with a cam actuated operating mechanism in response to lateral movement of a slide member in a similar manner to the previously discussed patent.

Adjustable angle foil apparatus including a flexible foil body member of plastic which is bent to adjust the foil angle is disclosed in other patents, including U.S. Pat. No. 4,162,937 of Corbelini, issued Jul. 31, 1979. In this foil, a nose portion at the front of the foil is made of a hard, wear resistant material such as stainless steel or ceramic, while the body portion of the foil is made of flexible material such as plastic which is bent for adjustment of the foil angle by rotation of an eccentric shaft coupled to the end of such rear portion of the foil. This foil apparatus is not suitable for adjustment of rigid foil body members.

It has also been proposed in U.S. Pat. No. 3,535,201 of Reynolds, issued Oct. 20, 1970, to provide an adjustable angle foil with a rigid foil body in which the entire foil member is pivoted by means of a complicated and expensive mechanism including a plurality of threaded bolts. This is difficult and time consuming since each bolt and a variable length link must be individually adjusted to move a support in an arcuate keyway at both ends of the foil to vary the foil angle. Another rigid foil apparatus with foil angle adjustment is shown in U.S. Pat. No. 4,061,532 of Biondetti, issued Dec. 6, 1977, in which the foil strip is mounted on a tubular carrier, which is pivoted by a leaf spring for adjustment of the foil angle in response to the adjustment of threaded screws. The foil angle adjustment screws have different thread pitches at the opposite ends thereof, which is extremely complicated and expensive to make and difficult to adjust. More recently, rigid foil apparatus with adjustable foil angles have employed even more complicated threaded adjustment means, as shown in U.S. Pat. No. 4,416,731 of Pesonen, et al., issued Nov. 22, 1983. U.S. Pat. No. 4,865,692 of Kade, et al., issued Sep. 12, 1989 shows a rigid foil with an adjustable angle provided by an inflatable hose and adjustable stops, which is somewhat similar to the above-discussed Dunlap U.S. Pat. No. 3,027,940. However, Kade adds the additional complication of a flexible hinge and a slide cam member with adjustable stop surfaces thereon for adjusting the angle of the foil.

All of the above prior adjustable foil apparatus suffer from the disadvantages that they are either restricted to flexible foil bodies, which are bent to adjust the foil angle, or to rigid foil bodies with an extremely complicated and expensive foil angle adjustment mechanism involving threaded adjustment screws, arcuate keyways, adjustable length couplings and the like, which are extremely difficult and time consuming to operate in order to produce accurate angle adjustments of the foil regiments uniformly along the length of the foil. These problems have been solved by the adjustable foil apparatus of the present invention, which is suitable for use on a foil member having a rigid foil body of hard, wear resistant material such as ceramic material, to provide a long wearing foil member which does not have to be replaced frequently and whose foil angle can be adjusted quickly and accurately with a simple cam actuated adjustment mechanism, in order to simultaneously adjust the angle of all of the foil segments along the entire length of the foil to the same uniform foil angle.

The adjustable foil apparatus of the present invention has several advantages over the prior foil apparatus, including adjustment through the required foil range of 0° to 5° with great precision in small angle increments of 5/100th of a degree, as well as in larger ½ degree increments in a precise manner. In addition, the foil angle can easily be adjusted while the foil is still installed on the paper making machine, without removing the foil or stopping the paper making machine. This has the advantage that foil adjustments may be made quickly while the conveyor "wire" is running to check to see whether the foil causes a streak in the paper, which indicates that the foil is damaged or of an improper height. This enables detection of any such problem in a fast and inexpensive manner without stopping the machine unduly reducing the paper production output.

The foil angle adjustment mechanism of the present invention is cam actuated to provide a simple and inexpensive adjustment mechanism which is fast, reliable and precise in operation. Also, the cam actuated adjustment mechanism may be sealed from liquid paper stock corrosion and other damaging paper making environment conditions. Cam follower pins attached to the foil support member move along sloped cam slots in a mounting base member when such support member is caused to slide along such base member to adjust the foil angle. The pins are attached to the foil support member so that they cannot drop off the foil apparatus and fall into the paper making machine to damage to such machine. In addition, the adjustable foil apparatus of the present invention is simple and compact so that it may be installed as a retrofit into existing paper making machines with minimum down time and minimum adjustment of the machine.

In addition, the cam follower pins are provided in the present invention as eccentric pins to allow for small adjustments of the foil height of the leading edge of the foil along the length of the foil to maintain the foil segment heights substantially constant for different foil angle positions. The cam follower pins may be of a ceramic coated metal for longer life to reduce wear when sliding in the cam slots of the cam actuated operating mechanism. Also, the drive mechanism for movement of the cam actuator slide which moves the foil support member can be achieved by hand rotation or motor driven rotation of the control shaft connected to such cam actuator. Since the foil support member is the only moving part during adjustment of the foil angle, this greatly simplifies the operation of the foil apparatus.

SUMMARY OF THE INVENTION

It is therefore one object of the present invention to provide an improved foil apparatus for a paper making machine with a long wearing rigid foil body whose foil angle can be adjusted in a fast accurate manner by a simple trouble free operating mechanism.

Another object of the invention is to provide such a foil apparatus in which the foil angle adjustment mechanism is cam actuated in order to adjust the foil angle operating substantially uniformly across the entire length of the foil member.

A further object of the present invention is to provide such a foil apparatus in which the foil member is made of a rigid foil body, of ceramic or other hard wear resistant material to provide a foil of a long useful lifetime, and in which the foil body is pivoted but not bent to adjust the foil angle.

An additional object of the present invention is to provide such a foil apparatus in which the foil body is made of a plurality of foil segments of ceramic material which are attached to a il support member extending beneath such foil segments and such support member is mounted on a foil mounting member for sliding movement relative thereto during adjustment of the foil angle by the cam actuated operating mechanism.

Still another object of the present invention is to provide such an adjustable foil apparatus in which the cam actuated foil angle adjustment mechanism includes at least one set of cam slots and a plurality of cam follower pins extending into such slots, which cause pivoting of the foil support member in response to longitudinal movement of the foil support member relative to the foil mounting base member.

A still further object of the present invention is to provide such a foil apparatus in which the foil angle may be adjusted without removing the foil apparatus from the paper making machine or stopping the paper making machine.

A still additional object of the foil apparatus of the present invention is to provide a first cam means for adjustment of the foil angle with greater precision and a second cam means to maintain the foil height substantially constant at different foil angles.

A still further object of the present invention is to provide such a foil angle adjustment apparatus which may be retrofitted into existing paper making machines without rebuilding such machines.

Another object of the present invention is to provide such a foil apparatus in which the cam actuated adjusting mechanism is sealed from corrosive liquid in the paper making machine, thereby increasing the life of the adjustment mechanism.

An additional object of the invention is to provide such a foil apparatus in which the cam follower pins are eccentric pins which upon rotation allow fine adjustments of the height of the foil member and are locked to the foil support member to prevent them from falling into the paper making machine and causing damage thereto.

BRIEF DESCRIPTION OF DRAWINGS

Other objects and advantages of the present invention will be apparent from the following detailed description of certain preferred embodiments thereof and from the attached drawings of which.

DESCRIPTION OF PREFERRED EMBODIMENTS

Figure 3:
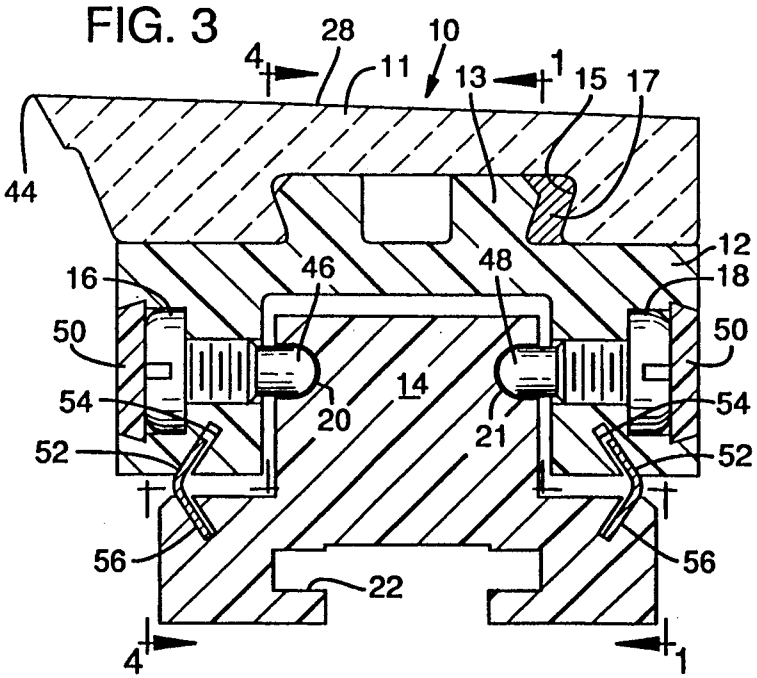
FIG. 3 is an enlarged vertical section view taken along the line 3—3 of FIG. 1.

As shown in FIGS. 1 to 4, one embodiment of the adjustable angle foil apparatus of the present invention includes a foil member 10 having a rigid foil body which may be made of a plurality of foil segments 11 of ceramic material, such as zirconium oxide ceramic, or other hard abrasive resistant material. The foil segments 11 are mounted on a foil support member 12 of non-ceramic material such as fiberglass reinforced plastic, which may be a vinylester. The foil support member 12 in provided with a tapered tongue projection 13, which extends into a tapered dovetail groove 15 in the bottom of each of the foil segments 11 and is secured by epoxy resin or other bonding adhesive 17 provided in the space between the rear of the dovetail projection 13 and the rear of the groove 15 as shown in FIG. 3. The foil support member 12 extends across the entire width of the paper making machine and under the full length of the foil member 10 to support all of the foil segments. The foil support member 12 is coupled to a foil mounting base member 14 of fiberglass reinforced plastic material or stainless steel by means of two sets of cam follower pins 16 and 18 of stainless steel which extend into cam slots 20 and 21, respectively, in the front surface and the rear surface of the mounting base 14, in a manner hereafter described. The foil mounting base member 14 is secured to the machine frame in a conventional manner by a T-shaped slot 22 in the bottom thereof, into which a T-shaped bar or rail (not shown) of stainless steel is inserted when the foil mounting base is installed on the paper making machine.

Figure 1:
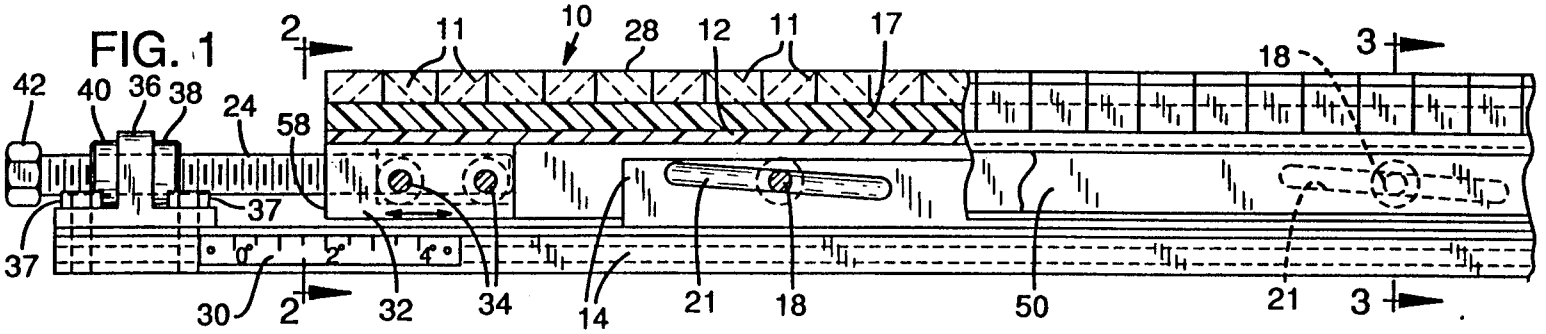
FIG. 1 is a rear plan view of one embodiment of the foil apparatus of the present invention with parts broken away to show the cam actuated foil angle adjustment mechanism.

The cam follower pins 16 and 18 have threaded shanks which are threaded into holes in the opposite sides of the foil support member 12 so that the inner ends of such pins extend into the cam slots 20 and 21 on opposite sides of the foil mounting base 14. As a result when the foil support member 12 slides longitudinally during adjustment of the foil angle by rotation of an adjustment control shaft 24, the rear or trailing portion of foil member 10 is caused to move upward or downward relative to a fabric conveyor belt 26 of the paper making machine which moves from left to right in FIG. 2, in order to change the foil angle 27 between the upper surface 28 of the foil member 10 and such conveyor belt in a range of approximately 0° to 5.0°. Thus, as shown in FIG. 1, the rear cam slots 21 slope upwardly from right to left so that movement of the cam follower pin 18 in such slot causes the foil member 10 to pivot, thereby changing the foil angle. When the pin 18 is in the middle of the slot 21 as shown in FIG. 1, the foil angle is set at approximately 2.0°. However, as the pin 18 moves downward to the right in slot 21, the foil angle increases to a maximum and approximately 4° as indicated by an angle indicator scale 30 fixed to the rear of the mounting base member 14.

Figure 2:
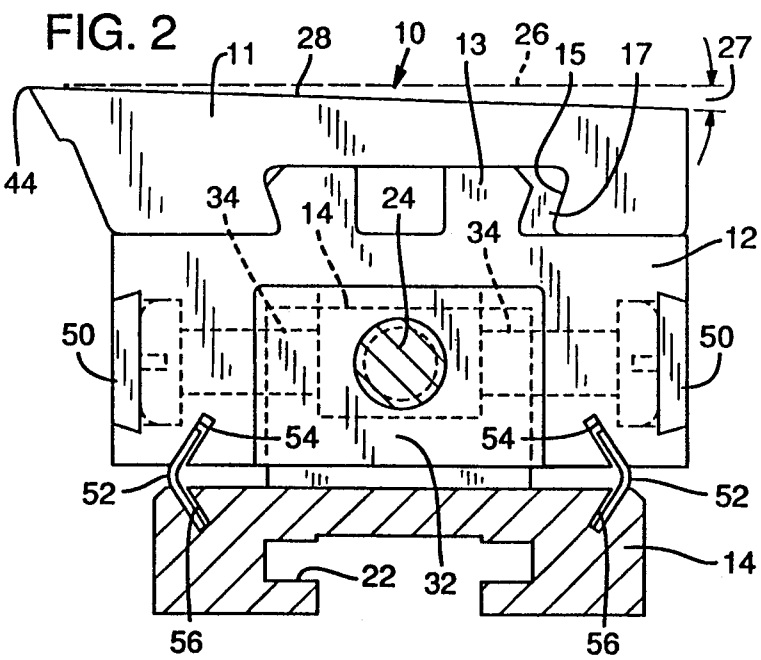
FIG. 2 is an enlarged vertical section view taken along the line 2—2 of FIG. 1.

As shown in FIGS. 1 and 2, the foil angle adjustment shaft 24 is connected at one end to an end cap coupling 32 which is attached to the foil support member 12 by two bolts 34 extending through both sides of the foil support member. The adjustment shaft 24 is threaded at one end into an opening in the end cap 32 so that such end cap and the foil support member 12 move longitudinally in response to rotation of the adjustment shaft 24 in order to adjust the foil angle. The shaft 24 extends through a T-shaped support bracket 36 which is fixedly secured to the mounting base member 14 by bolts 37. A pair of threaded stop collars 38 and 40 are fixedly attached by welding to the adjustment shaft 24 on opposite sides of the T- bracket 36, and such stop collars prevent the shaft 24 from moving longitudinally. Thus, rotation of a hexagonal nut 42 welded to the outer end of the shaft 24, causes the shaft to rotate, which in turn, causes the end cap 32 and the foil support member 12 to move longitudinally. Longitudinal movement of the support member 12 moves the cam follower pins 18 along the rear cam slots 21 of the fixed mounting base member 14 to adjust the foil angle 27 by pivoting the foil member 10 which causes the rear end of such foil to move up and down.

Figure 4:
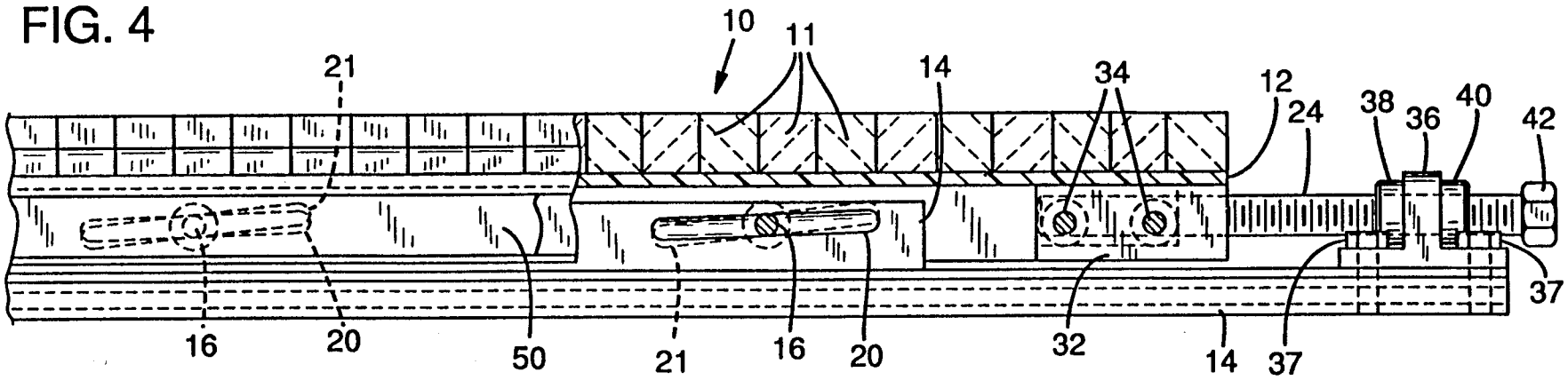
FIG. 4 is a partial front plan view and vertical section taken along the line 4—4 of FIG. 3.

In order to maintain the foil height of a leading edge 44 at the front end of the foil substantially constant for different foil angle adjustments, a non-resilient mounting means including a set of front cam slots 20 and cam follower pins 16 are arranged in the front side of the mounting base member 14, as shown in FIG. 4. The front cam slots 20 slope in the same direction with a lesser horizontal angle than the rear cam slots 21, such as an angle of 1.86° for slots 20 and an angle of 3.53° for slots 21, as shown in FIG. 4. Thus when the foil angle is increased, the foil member tends to be lowered by the pins 18 sliding down in rear cam slots 21, which tends to raise the leading edge. This is fully compensated for by the pins 16 sliding down in front cam slots 20 to maintain the height of leading edge 44 constant. In order to make small calibration adjustments to maintain the same uniform height along the length of the foil member 10 for each of the foil segments 11 the cam follower pins 16 and 18 are eccentric pins. These eccentric pins each have an axis of rotation which is offset approximately 0.005" from the axis of symmetry of the pin. The pins are made of any suitable non-corrosive metal such as stainless steel and have a threaded pin shaft from the enlarged head portion to an unthreaded hemispherical end portion 46 which extends into the cam slots 20 or 21. In addition, the hemispherical ends 46 and 48 respectively of the pins may be coated with ceramic material to further reduce wear. In order to prevent tampering of the pins 16 and 18, once they are adjusted to their proper calibrated position, a pair of cover strips 50 of fiberglass reinforced plastic material is provided over the top of the enlarged ends of the pins and attached to the foil support member 12 by means of a sliding dovetail joint, as shown in FIG. 3.

As shown in FIG. 3, a pair of resilient seal members 52 of rubber or other elastomer material are mounted in inclined slots 54 in the bottom of the foil support member 12 and in corresponding inclined slots 56 in the outer flanges of the mounting base member 14, in order to seal the cam actuated operating mechanism from corrosive liquid such as the paper pulp slurry in the paper making machine. As stated previously, the mounting base member 14 is slideably mounted by a T-shaped slot 22 in the bottom thereof on a T-shaped support rail (not shown) of stainless steel or fiberglass reinforced plastic material fixed to the frame of the paper making machine. It should be noted that the top of the mounting groove 22 may be relieved by a shallow groove in order to reduce friction during the installation and removal of the mounting base member 14 from the T-bar.

As a result of the fact that the height of the leading edge 44 of the foil member 10 is maintained substantially constant by cam slots 20 and pins 16 during adjustment of the foil angle 27, such foil angle adjustments may be made while the foil is positioned on the paper making machine and without stopping the conveyor belt. This has the decided advantage of increased paper production and of rapid trouble shooting to determine the cause of any streaking in the paper product. Thus, by changing the angle of a foil, it can be determined if that particular foil is causing streaking. Also, the foil angle can be adjusted in the range of approximately 0° to 5° and these adjustments can be made in an extremely precise manner in small steps of 5/100th of a degree or in larger steps of approximately ½ degree depending upon the needs of the operator. In this regard, the angle indicator scale 30, which is shown marked only with ½° increments, can be further marked smaller increments. It should be noted that the left end of the foil support member 12, indicated by reference numeral 58 is the actual pointer which indicates the foil angle on the angle scale 30. Thus, in the position shown in FIG. 1, the foil angle is set at 2.0°.

It should be noted that the cam follower pins 16 and 18 are spaced apart approximately 6 to 8 inches longitudinally along the length of the foil support member 12. The length of the foil segments 11 in the conveyor belt direction is approximately 2 to 3" and the width of such segments is about ¾ inch while overall length of the foil support member 12 and the foil member 10 mounted thereon will be approximately 6 inches longer than the conveyor belt width. Also, it should be noted that the range of travel of the cam follower pins 16 and 18 in the cam follower slots is a maximum of 2.5" with the pins being shown in the middle of such range and corresponding to a foil angle of 2°. Thus, when the rear pins 18 are in the left end of the rear cam slot 21, in FIG. 1, the foil angle is approximately 0°, and when such pins are in the right end of such slot, the foil angle setting is approximately 4°. Also, it should be noted that there is sufficient clearance between the top of the foil mounting base member 14 and the top of the U-shaped channel in the bottom surface of the foil support member 12 to allow pivotal movement of such foil support member during foil angle adjustment. In FIG. 3, the top spacing between the foil support member 12 and the foil mounting base 14 is shown for a foil angle setting of 2°. With a foil angle of 0°, the rear end of the support member 12 will be raised while at a foil angle of 4° the rear end of the foil support member 12 will be lower from that shown in FIG. 3.

Figure 5:
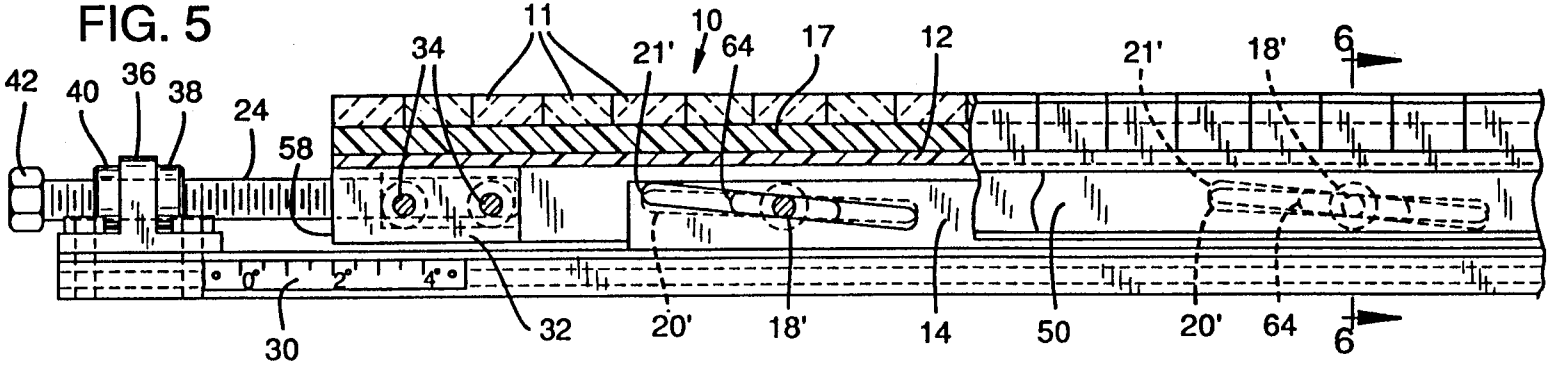
FIG. 5 is a rear plan view of a second embodiment of the foil apparatus of the present invention with parts broken away to show the cam follower pins having slide rods mounted on the ends of such pins which slide in the cam slots.
Figure 6:
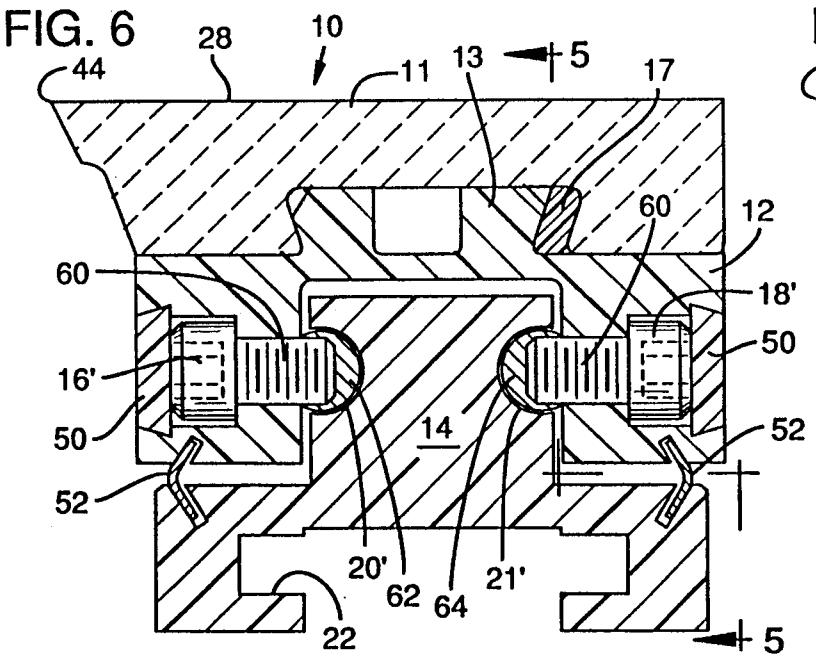
FIG. 6 is an enlarged vertical section view taken along the lines 6—6 of FIG. 5.

A second embodiment of the adjustable foil apparatus of the present invention is shown in FIGS. 5 and 6, which is similar to that of the first embodiment of FIGS. 1 to 4, so that only the differences will be described and the same reference numerals will be used to designate similar parts. In the second embodiment of FIGS. 5 and 6, the cam follower pins 16' and 18' differ from those shown in FIG. 3 by replacing the hemispherical end portions 46 of the pins with cam slide rods 62 and 64, which are threadedly fastened to the ends of the threaded shanks of pins 16' and 18', respectively. The slide rods 62 and 64 extend longitudinally along the cam slots 20' and 21' and across the pin shafts a substantial distance beyond the enlarged head of the pins as shown in FIG. 5, for greater accuracy in foil angle adjustment. This requires that the cam slots 20' and 21' be elongated somewhat over those of FIGS. 1 and 4 to obtain the same range of foil angle adjustments with the combination of the set of cam slots 20' and cam follower pins 16' providing non-resilient mounting means. Other than these differences, the adjustable foil apparatus of FIGS. 5 and 6 is substantially the same as that of the embodiment of FIG. 1 to 4.

Figure 7:
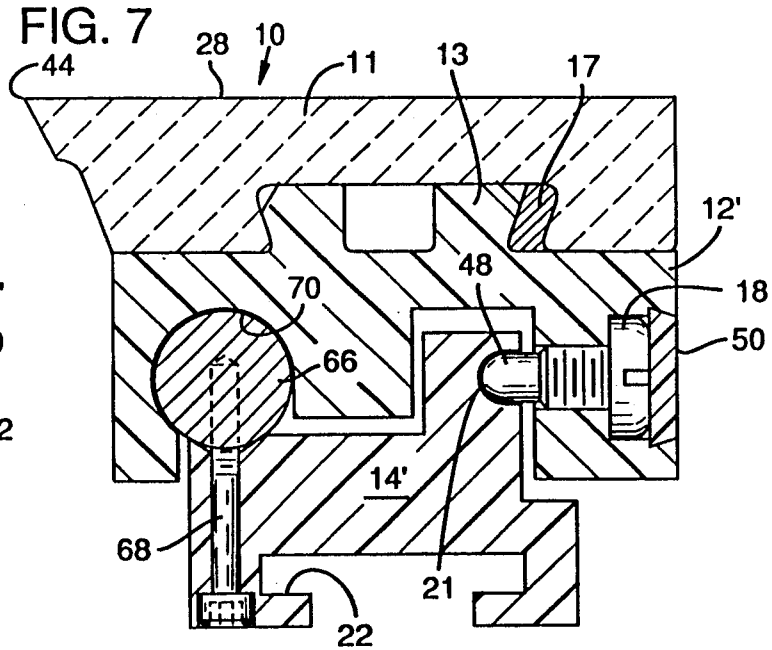
FIG. 7 is a vertical cross-section view showing a third embodiment of the foil apparatus of the present invention in which a pivot rod is provided on the foil mount base member adjacent the front edge thereof, which cooperates with the cam actuated foil angle adjustment means to pivot the foil member about such pivot rod.

A third embodiment of the adjustable foil apparatus of the present invention is shown in FIG. 7, which is similar to that of the first embodiment of FIGS. 1 to 4, so that again only the differences will be described and the same reference numerals will be used for similar parts. The embodiment of FIG. 7 includes a single set of cam slots 21 and cam follower pins 18 at the rear of the modified foil support member 12' and the rear of the modified foil mounting base 14'. In place of the front cam slots 20 and the cam follower pins 16 of FIG. 3, the embodiment of FIG. 7 employs a pivot rod 66, which is fixed in a V-shaped notch in the top on the modified foil mounting base 14' by bolts 68 extending upward through such mounting base and spaced longitudinally along such pivot rod. The pivot rod extends into a semicircular pivot groove 70 in the bottom of the modified foil support member 12'. The pivot groove 70 extends along the full length of the foil support member 12' and enables such support member to pivot about the axis of the pivot rod 66 in response to the cam actuation by movement of the cam pins 18 in the cam slots 21, such pivot rod and pivot groove providing the non-resilient mounting means. Thus, as the hemispherical ends 48 of the cam pins 18 slide in the cam slots 21, the foil support member 12' pivots about the pivot rod 66 to enable adjustment of the foil surface 28 into different foil angles. It should be noted that the pivot rod 66 may be made of stainless steel as are the mounting bolts 66 while the mounting base member 14' is made of fiberglass reinforced plastic material such as vinylester as is the foil support member 12'. The cam follower pins 18 are also made of stainless steel. However, it is also possible to make the pivot rod 66 of fiberglass reinforced plastic material.

The third embodiment of FIG. 7 has the disadvantage that the height of the leading edge 44 of the foil is not maintained constant, but can vary + or −0.015" during adjustment of the foil angle from a center position of 2° to the range ends of 0° and 4°. Since in the embodiment of FIG. 7 the foil support member 12' and foil member 10 pivot about the longitudinal axis of the pivot rod 66, it is advantageous to locate such pivot rod as close as possible to the leading edge 44 of the foil to reduce height changes of such leading edge. However, in some applications this slight variation in foil height will not materially adversely affect the performance of the paper making machine.

It will be obvious to those having ordinary skill in the art that many changes may be made in the above described preferred embodiments of the present invention. Therefore the scope of the present invention should be determined by the following claims.

I claim:

1. Drainage foil apparatus with adjustable foil angle for a papermaking machine, comprising:

foil means for removing water from paper pulp stock carried by a conveyor across said foil means, said foil means including a rigid foil member having a foil leading portion rigidly connected to a foil trailing portion and an upper surface of the foil member comprising a hard wear resistant material;

non-resilient mounting means for mounting said rigid foil member on a mounting base member structured to enable pivoting of said foil member while maintaining the height of the foil leading portion substantially constant;

foil angle adjustment means for adjusting the foil angle between said foil trailing portion and said conveyor, said foil angle adjustment means including a cam actuation means having a first set of cam slots and cam follower projections within said cam slots, said first set being spaced along the rear of the mounting base member extending beneath said foil member, and said foil member being mounted on said base member by said cam slots and projections so that longitudinal movement of said foil member relative to said base member causes said foil member to pivot and thereby change said foil angle; and control means for longitudinally moving said foil member relative to said mounting base member by a predetermined amount to adjust said foil angle.

2. Drainage foil apparatus in accordance with claim 1 in which the projections are adjustable to calibrate the foil height of the foil leading portion above the mounting base member so that said foil height is substantially uniform along the length of the foil member.

3. Drainage foil apparatus in accordance with claim 1 in which the projections are provided on threaded pins which have eccentric shafts so that rotation of said pins enables said calibration adjustment of the foil height.

4. Drainage foil apparatus in accordance with claim 3 in which the projections include slide rods attached to the threaded pins so that said slide rods extend longitudinally along the cam slots.

5. Drainage foil apparatus in accordance with claim 3 in which the pins are threaded through holes in a support member to which said foil member is attached so that the inner ends of said pins engage cam slots in the base mounting member.

6. Drainage foil apparatus in accordance with claim 5 in which the outer ends of said pins are recessed below the surface of the support member and are covered by a cover member to prevent tampering with pins.

7. Drainage foil apparatus in accordance with claim 1 in which the foil member is composed of a plurality of foil segments of ceramic material spaced longitudinally along a foil support member, each of said foil segments having a foil leading portion rigidly connected to a foil trailing portion and formed integral therewith.

8. Drainage foil apparatus in accordance with claim 7 in which the foil segments are bonded by adhesive material to a foil support member of fiberglass reinforced plastic material.

9. Drainage foil apparatus in accordance with claim 1 in which the foil angle adjustment means includes a second set of cam slots and projections spaced along the front of said mounting base member in order to maintain the height of the foil leading portion above the mounting base member substantially constant at different foil angles.

10. Drainage foil apparatus in accordance with claim 9 in which said foil member pivots during adjustment of the foil angle so that the front edge of said foil leading portion is maintained at a substantially constant height.

11. Drainage foil apparatus in accordance with claim 1 in which the foil angle adjustment means includes a pivot connection means adjacent the front of the mounting base member for pivotally connecting the foil member to said base member to enable said foil member to pivot about said pivot connection means during adjustment of said foil angle.

12. Drainage foil apparatus in accordance with claim 11 in which the pivot connection means includes a pivot rod fixed to the mounting base member and extending into a pivot groove on a support member attached to the foil member to enable said foil member to pivot about said pivot rod.

13. Drainage foil apparatus with adjustable foil angle for a papermaking machine, comprising:

foil means for removing water from paper pulp stock carried by a conveyor across said foil means, said foil means including a rigid foil member having a foil leading portion rigidly connected to a foil trailing portion and an upper surface of the foil member comprising a hard wear resistant material;

non-resilient mounting means for mounting said rigid foil member on a mounting base member structured to enable pivoting of said foil member while maintaining the height of the foil leading portion substantially constant;

foil angle adjustment means for adjusting the foil angle between said foil trailing portion and said conveyor, said foil angle adjustment means including a cam actuation means having a first set of cam slots and cam follower projections within said cam slots, said first set being spaced along the rear of the mounting base member extending beneath said foil member, and said foil member being mounted on said base member by said cam slots and projections so that longitudinal movement of said foil member relative to said base member causes said foil member to pivot and thereby change said foil angle without bending said foil member; and control means including a rotary control shaft, for longitudinally moving said foil member relative to said mounting base member by a predetermined amount to adjust said foil angle in response to rotation of said control shaft.

14. Drainage foil apparatus in accordance with claim 13 in which the projections are adjustable to calibrate the foil height of the foil leading portion above the mounting base member so that said foil height is substantially uniform along the length of the foil member.

15. Drainage foil apparatus in accordance with claim 13 in which the projections are provided on threaded pins which have eccentric shafts so that rotation of said pins enables said calibration adjustment of the foil height.

16. Drainage foil apparatus in accordance with claim 15 in which the projections include slide rods attached to the threaded pins so that said slide rods extend longitudinally along the cam slots.

17. Drainage foil apparatus in accordance with claim 13 in which the pins are threaded through holes in a support member to which said foil member is attached so that the inner ends of said pins engage cam slots in the base mounting member.

18. Drainage foil apparatus in accordance with claim 13 in which the foil member is composed of a plurality of foil segments of ceramic material spaced longitudinally along a foil support member, each of said foil segments having a foil leading portion rigidly connected to a foil trailing portion and formed integral therewith.

19. Drainage foil apparatus in accordance with claim 13 in which the foil angle adjustment means includes a second set of cam slots and projections spaced along the front of said mounting base member in order to maintain the height of the foil leading portion above the mounting base member substantially constant at different foil angles.

20. Drainage foil apparatus in accordance with claim 13 in which the foil angle adjustment means includes a pivot rod connection means adjacent the front of the mounting base member for pivotally connecting the foil member to said base member to enable said foil member to pivot about said pivot rod during adjustment of said foil angle.

* * * * *

UNITED STATES PATENT AND TRADEMARK OFFICE

CERTIFICATE OF CORRECTION

PATENT NO. : 5,169,500

DATED : December 8, 1992

INVENTOR(S) : Daniel E. Mejdell

It is certified that error appears in the above-identified patent and that said Letters Patent is hereby corrected as shown below:

Column 3, line 13, "to damage" should read --doing damage--;

Column 3, line 56, "il" should read --foil--;

Column 5, line 1, "in" should read --is--

Column 5, line 44, "and" should read --of--;

Column 7, line 3, "marked smaller" should read --marked with smaller--; and

Column 9, line 11, "claim 1" should read --claim 2--.

Signed and Sealed this

Twenty-second Day of February, 1994

Bruce Lehman

*Attest:*

BRUCE LEHMAN

*Attesting Officer*

*Commissioner of Patents and Trademarks*